US007857434B2

(12) United States Patent
Tsukamura

(10) Patent No.: US 7,857,434 B2
(45) Date of Patent: Dec. 28, 2010

(54) LIQUID DISCHARGING HEAD, LIQUID DISCHARGING DEVICE, AND IMAGE FORMING APPARATUS

(75) Inventor: Kiyoshi Tsukamura, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 163 days.

(21) Appl. No.: 11/937,050

(22) Filed: Nov. 8, 2007

(65) Prior Publication Data

US 2008/0136874 A1 Jun. 12, 2008

(30) Foreign Application Priority Data

Nov. 8, 2006 (JP) ..... 2006-302174

(51) Int. Cl.
*B41J 2/045* (2006.01)

(52) U.S. Cl. ..... 347/71

(58) Field of Classification Search ..... 347/70–72
See application file for complete search history.

(56) References Cited

U.S. PATENT DOCUMENTS

| | | | | |
|---|---|---|---|---|
| 5,446,485 | A * | 8/1995 | Usui et al. | 347/72 |
| 2005/0237350 | A1 * | 10/2005 | Aoki | 347/9 |
| 2006/0233578 | A1 | 10/2006 | Maki et al. | |

FOREIGN PATENT DOCUMENTS

| | | | |
|---|---|---|---|
| EP | 518380 | A2 * | 12/1992 |
| JP | 2000-351215 | | 12/2000 |
| JP | 2000-351217 | | 12/2000 |
| JP | 2001-47622 | | 2/2001 |
| JP | 3198221 | | 6/2001 |
| JP | 2003-211658 | | 7/2003 |
| JP | 2004-82650 | | 3/2004 |
| JP | 2005-88206 | | 4/2005 |
| JP | 2006-224479 | | 8/2006 |
| JP | 3909746 | | 2/2007 |

OTHER PUBLICATIONS

Machine translation of JP 2003211658A.*

* cited by examiner

*Primary Examiner*—Matthew Luu
*Assistant Examiner*—Lisa M Solomon
(74) *Attorney, Agent, or Firm*—Cooper & Dunham LLP

(57) ABSTRACT

A liquid discharging head includes a nozzle, a pressing liquid chamber, a plurality of energy generators, and a base. The nozzle discharges a liquid drop. The pressing liquid chamber is connected to the nozzle and contains liquid. The plurality of energy generators generates energy for applying pressure to the liquid contained in the pressing liquid chamber. The plurality of energy generators is provided on the base in a longitudinal direction of the base. The base includes an adhering surface and a wide portion. The plurality of energy generators is provided on the adhering surface. The wide portion has a width greater than a width of the adhering surface in a short direction of the base.

18 Claims, 12 Drawing Sheets

LIQUID DISCHARGING HEAD, LIQUID DISCHARGING DEVICE, AND IMAGE FORMING APPARATUS

BACKGROUND

1. Technical Field

The present specification describes a liquid discharging head, a liquid discharging device, and an image forming apparatus, and more particularly, a liquid discharging head, a liquid discharging device, and an image forming apparatus for forming an image on a recording medium by discharging liquid onto the recording medium.

2. Discussion of the Background

An image forming apparatus, such as a copying machine, a printer, a facsimile machine, a plotter, or a multifunction printer having two or more of copying, printing, scanning, and facsimile functions, forms an image on a recording medium (e.g., a sheet) by a liquid discharging method. For example, a liquid discharging head (e.g., a recording head) included in a liquid discharging device discharges liquid (e.g., an ink drop) onto a conveyed sheet. The liquid is adhered to the sheet to form an image on the sheet.

The image forming apparatus and the liquid discharging device may be used in an industrial system including a printing device and metal wire. Accordingly, the image forming apparatus and the liquid discharging device are requested to form a high-quality image at a high print speed.

To output a high-quality image, the image forming apparatus and the liquid discharging device may include an increased number of nozzles arranged at high densities, liquid chambers may be arranged with a decreased distance provided between the adjacent liquid chambers, and energy may be applied at an increased frequency.

In addition, to form an image at a high print speed, the image forming apparatus and the liquid discharging device may include a long liquid discharging head (e.g., a line-type head) covering a whole width of a sheet.

One example of the liquid discharging head includes a nozzle, a liquid chamber, and a pressure generator. The nozzle discharges a liquid drop. The nozzle is connected to the liquid chamber. The pressure generator generates pressure for pressing liquid in the liquid chamber. Namely, pressure generated by the pressure-generator presses liquid in the liquid chamber, so that the nozzle discharges a liquid drop. The pressure generator generates pressure using a thermal method, a piezoelectric method, or an electrostatic method.

In the piezoelectric method, a piezoelectric element is adhered to a base (e.g., a metal member). A plurality of piezoelectric elements or a plurality of heads including a piezoelectric element is arranged to form a long head such as a line-type head.

In the thermal method, a plurality of boards including a thermal conversion-element is arranged on a base to form a long head such as a line-type head.

To manufacture a long, line-type head without increasing the size of the head, a plurality of piezoelectric elements may be disposed on a single base. In this case, surface grinding is performed on the single base to give the base a flat surface over which there is no more than about a 20 μm difference in height between a thickest part and a thinnest-part of the base.

However, the desired flatness may not be obtained over the whole base due to thermal deformation during processing. Consequently, the base may be warped and a thickness of an adhesive applied between the base and the piezoelectric elements may vary, causing faulty adhesion. As a result, the piezoelectric elements may not be properly adhered to a vibration plate.

In the thermal method, a board including a thermal conversion element is adhered to a base, and a nozzle plate is adhered to the board. Therefore, a nozzle may not properly discharge a liquid drop onto a sheet if the base is warped. For example, the nozzle may not discharge a liquid drop in a uniform direction. As a result, the liquid drop may spread on the sheet.

SUMMARY

This patent specification describes a novel liquid discharging head. One example of a novel liquid discharging head includes a nozzle, a pressing liquid chamber, a plurality of energy generators, and a base. The nozzle is configured to discharge a liquid drop. The pressing liquid chamber is connected to the nozzle and is configured to contain liquid. The plurality of energy generators is configured to generate energy for applying pressure to the liquid contained in the pressing liquid chamber. The plurality of energy generators is provided on the base in a longitudinal direction of the base. The base includes an adhering surface and a wide portion. The plurality of energy generators is provided on the adhering surface. The wide portion has a width greater than a width of the adhering surface in a short direction of the base.

This patent specification further describes a novel liquid discharging device. One example of a novel liquid discharging device includes a liquid discharging head configured to discharge a liquid drop. The liquid discharging head includes a nozzle, a pressing liquid chamber, a plurality of energy generators, and a base. The nozzle is configured to discharge the liquid drop. The pressing liquid chamber is connected to the nozzle and is configured to contain liquid. The plurality of energy generators is configured to generate energy for applying pressure to the liquid contained in the pressing-liquid chamber. The plurality of energy generators is provided on the base in a longitudinal direction of the base. The base includes an adhering surface and a wide portion. The plurality of energy generators is provided on the adhering surface. The wide portion has a width greater than a width of the adhering surface in a short direction of the base.

This patent specification further describes a novel image forming apparatus. One example of a novel image forming apparatus includes a liquid discharging head configured to discharge a liquid drop. The liquid discharging head includes a nozzle, a pressing liquid chamber, a plurality of energy generators, and a base. The nozzle is configured to discharge the liquid drop to form an image. The pressing liquid chamber is connected to the nozzle and is configured to contain liquid. The plurality of energy generators is configured to generate energy for applying pressure to the liquid contained in the pressing liquid chamber. The plurality of energy generators is provided on the base in a longitudinal direction of the base. The base includes an adhering surface and a wide portion. The plurality of energy generators is provided on the adhering surface. The wide portion has a width greater than a width of the adhering surface in a short direction of the base.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
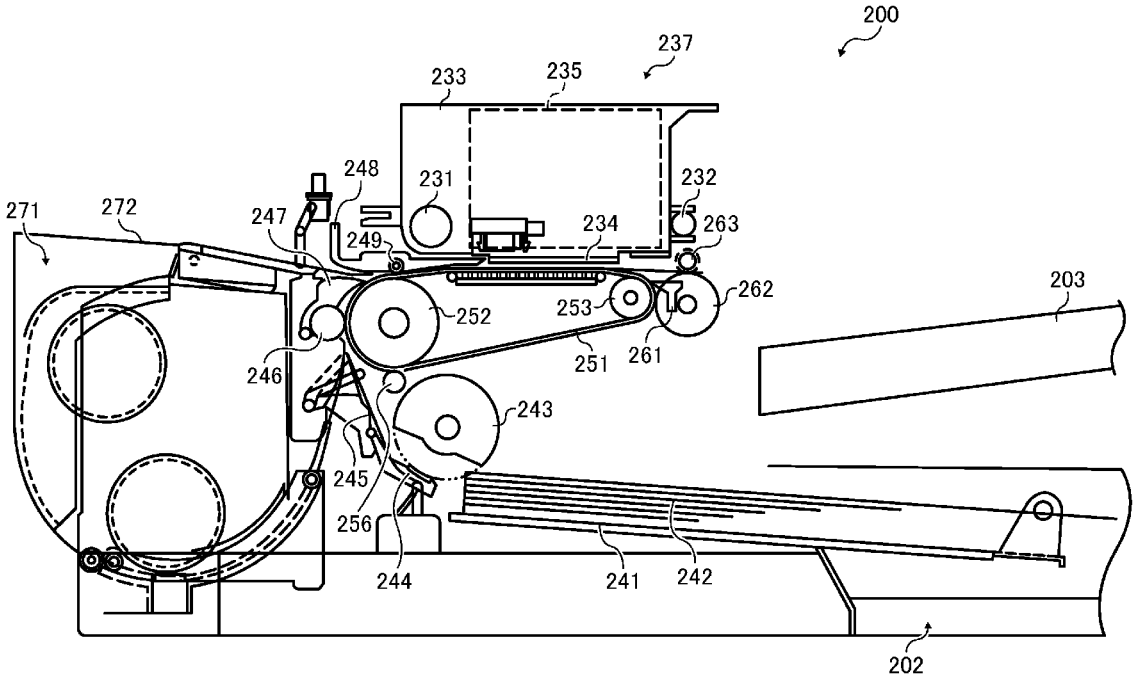
FIG. 1 is a schematic view of an image forming apparatus according to an exemplary embodiment.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 200 according to an exemplary embodiment is explained.

As illustrated in FIG. 1, the image forming apparatus 200 includes a paper tray 202, a feeding roller 243, a separating pad 244, a guide 245, a counter roller 246, a conveying guide 247, a pressing member 248, a conveying belt 251, a conveying roller 252, a tension roller 253, a charging roller 256, guide rods 231 and 232, a carriage 233, a liquid discharging device 237, a separating nail 261, output rollers 262 and 263, an output tray 203, a duplex unit 271, and a bypass tray 272. The paper tray 202 includes a plate 241. The liquid discharging device 237 includes a recording head 234 and a head tank 235. The pressing member 248 includes a pressing roller 249.

The image forming apparatus 200 can be any of a copying machine, a printer, a facsimile machine, a plotter, and a multifunction printer including copying, printing, scanning, and facsimile functions. In this non-limiting exemplary embodiment, the image forming apparatus 200 functions as a serial type image forming apparatus for forming an image on a recording medium.

The paper tray 202 loads a recording medium (e.g., a plurality of sheets 242), which is not limited to paper. For example, the sheets 242 are placed on the plate 241. The feeding roller 243 is formed in a half-moon-like shape. The separating pad 244 opposes the feeding roller 243 and includes a material having an increased friction coefficient. The separating pad 244 is pressed towards the feeding roller 243. Thus, the feeding roller 243 separates an uppermost sheet 242 from the other sheets 242 placed on the plate 241 to feed the sheets 242 one by one towards the guide 245.

The guide 245 guides the sheet 242 towards a position between the counter roller 246 and the conveying belt 251 opposing each other. The counter roller 246 feeds the sheet 242 towards the conveying guide 247. The conveying guide 247 turns a conveyance direction of the sheet 242 by about 90 degrees, and guides the sheet 242 towards the pressing member 248. The pressing roller 249 of the pressing member 248 presses the sheet 242 onto the conveying belt 251. The conveying belt 251 electrostatically attracts the sheet 242 and conveys the sheet 242 at a position under the recording head 234 and opposing the recording head 234.

The conveying belt 251 is formed in an endless belt-like shape, and is looped over the conveying roller 252 and the tension roller 253. The conveying belt 251 rotates in a belt conveyance direction (e.g., a sub-scanning direction). The charging roller 256 charges a surface of the conveying belt 251. The charging roller 256 contacts a surface layer of the conveying belt 251 and is driven by the rotating conveying belt 251. A sub-scanning motor (not shown)-rotates the conveying roller 252 via a timing belt (not shown). The rotating conveying roller 252 rotates the conveying belt 251 in the sub-scanning direction.

The guide rods 231 and 232 support the carriage 233 in a manner that the carriage 233 slides on the guide rods 231 and 232 in a main scanning direction. The recording head 234 is mounted on the carriage 233, and discharges a liquid drop (e.g., an ink drop) onto the sheet 242 conveyed on the conveying belt 251 to form an image on the sheet 242. The head tank 235 is mounted on the carriage 233, and contains ink to be supplied to the recording head 234. According to this non-limiting exemplary embodiment, the liquid discharging device (e.g., the liquid discharging device 237) includes the recording head 234 and the head tank 235. However, the liquid discharging device may not include the head tank 235 or may include an element other than the head tank 235.

The separating nail 261 separates the sheet 242 bearing the image from the conveying belt 251. The output rollers 262 and 263 feed the sheet 242 separated from the conveying belt 251 onto the output tray 203. The output tray 203 is disposed under the output roller 262, and receives the sheet 242 fed by the output roller 262.

The duplex unit 271 is attached to a back portion of the image forming apparatus 200. The duplex unit 271 is attachable to and detachable from the image forming apparatus 200. To form an image on another side (e.g., a back side) of the sheet 242, the conveying belt 251 rotates back the sheet 242 towards the duplex unit 271. The duplex unit 271 receives and reverses the sheet 242, and sends the sheet 242 to the position between the counter roller 246 and the conveying belt 251 opposing each other again. The bypass tray 272 is provided on a top of the duplex unit 271. A sheet (e.g., thick paper, a postcard, and/or the like), which is not easily bent, is placed on the bypass tray 272, and is fed towards the conveying belt 251.

Figure 2:
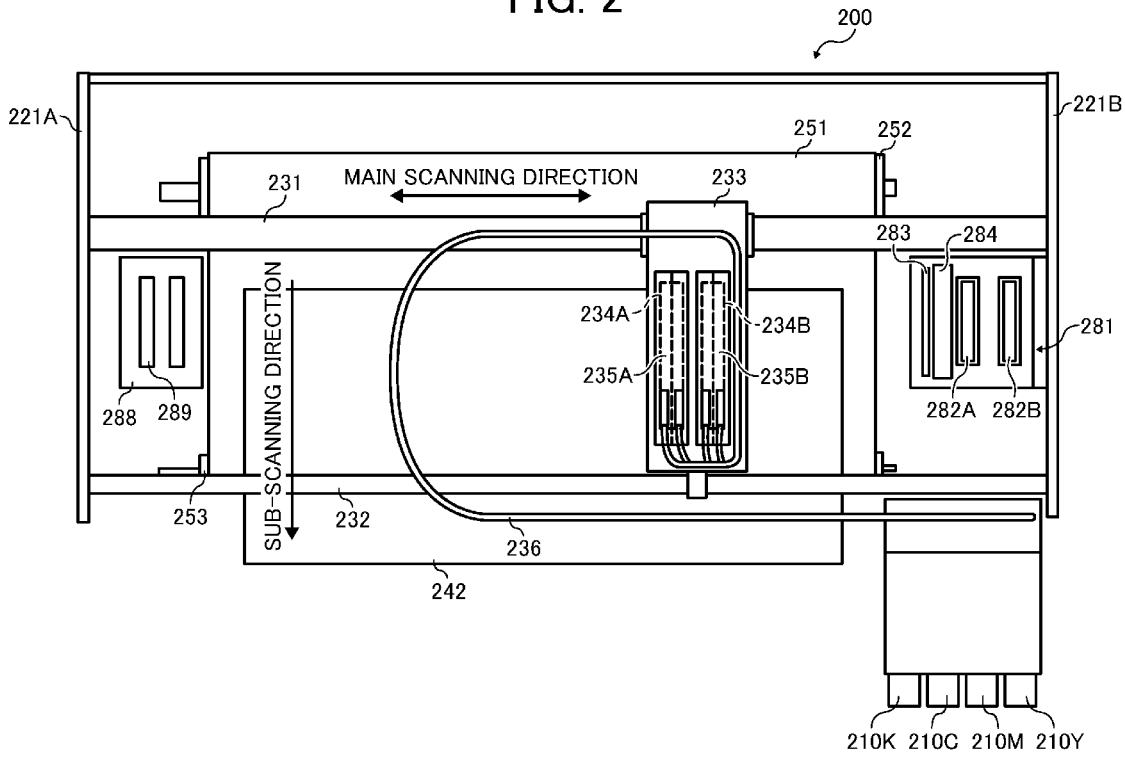
FIG. 2 is a plane view of the image forming apparatus shown in FIG. 1.

As illustrated in FIG. 2, the image forming apparatus 200 further includes side plates 221A and 221B, recording heads 234A and 234B, head tanks 235A and 235B, ink cartridges 210K, 210C, 210M, and 210Y, a supply tube 236, a maintenance-recovery mechanism 281, and an ink collecting unit 218. The maintenance-recovery mechanism 281 includes caps 282A and 282B, a wiper blade 283, and an idle discharge receiver 284. The ink collecting unit 288 includes an opening 289.

The side plates 221A and 221B support the guide rods 231 and 232. A main scanning motor (not shown) moves the carriage 233 on the guide rods 231 and 232 in a main scanning direction via a timing belt (not shown).

Each of the recording heads 234A and 234B, serving as a liquid discharging head, includes two nozzles. One of the two nozzles of the recording head 234A discharges a black liquid drop. Another nozzle of the recording head 234A discharges a cyan liquid drop. One of the two nozzles of the recording head 234B discharges a magenta liquid drop. Another nozzle of the recording head 234B discharges a yellow liquid drop. The recording heads 234A and 234B are attached to the carriage 233 in a manner that the nozzles are arranged in the sub-scanning direction and discharge liquid drops downward.

The head tanks 235A and 235B are mounted on the carriage 233. The head tank 235A supplies black and cyan inks to the nozzles of the recording head 234A, respectively. The head tank 235B supplies magenta and yellow inks to the nozzles of the recording head 234B, respectively. The ink cartridges 210K and 210C supply black and cyan inks to the head tank 235A via the supply tube 236. The ink cartridges 210M and 210Y supply magenta and yellow inks to the head tank 235B via the supply tube 236.

The maintenance-recovery mechanism 281 is disposed in a non-printing area near one end in the main scanning direction in which the carriage 233 moves. The maintenance-recovery mechanism 281 maintains and recovers conditions of the nozzles of the recording heads 234A and 234B. The caps 282A and 282B cap the nozzles of the recording heads 234A and 234B, respectively. The wiper blade 283 wipes the nozzles of the recording heads 234A and 234B. The idle discharge receiver 284 receives a liquid drop discharged during idle discharge from the recording heads 234A and 234B but not used for printing, so as to output liquid having an increased viscosity.

The ink collecting unit 288 (e.g., an idle discharge receiver) is disposed in another non-printing area near the other end in the main scanning direction in which the carriage 233 moves. The ink collecting unit 288 receives and collects a liquid drop discharged during idle discharge from the recording heads 234A and 234B but not used for printing, so as to output liquid of which viscosity is increased during printing. The opening 289 is arranged along a direction in which the nozzles of the recording heads 234A and 234B are arranged.

Referring to FIG. 1, the following describes operations of the image forming apparatus 200. The feeding roller 243 and the separating pad 244 separate and feed sheets 242 placed on the plate 241 one by one from the paper tray 202. The guide 245 guides the sheet 242 substantially upward to a nip formed between the counter roller 246 and the conveying roller 252 via the conveying belt 251. The conveying guide 247 guides a foremost head of the sheet 242 towards the pressing roller 249. The pressing roller 249 presses the sheet 242 onto the conveying belt 251 to turn the conveyance direction of the sheet 242 by about 90 degrees.

An alternating voltage, in which positive and negative charges are alternately output repeatedly, is applied to the charging roller 256. The charging roller 256 charges the conveying belt 251 with positive and negative charges in a manner that the positive and negative charges alternately applied and having a predetermined width form stripes in the sub-scanning direction in which the conveying belt 251 rotates. When the sheet 242 is fed onto the charged conveying belt 251, the conveying belt 251 attracts the sheet 242. The rotating conveying belt 251 conveys the sheet 242 in the sub-scanning direction.

When the carriage 233 moves, the recording head 234 is driven according to an image signal. The recording head 234 discharges a liquid drop onto the sheet 242 to print an image on one line of the sheet 242 while the sheet 242 stops on the conveying belt 251. When the conveying belt 251 conveys the sheet 242 for a predetermined distance, the recording head 234 prints an image on a next line of the sheet 242. When a controller (not shown) receives a signal indicating that a print operation is finished or a signal indicating that a tail of the sheet 242 reaches a print area, the print operation is finished, and the sheet 242 is output onto the output tray 203.

Figure 3:
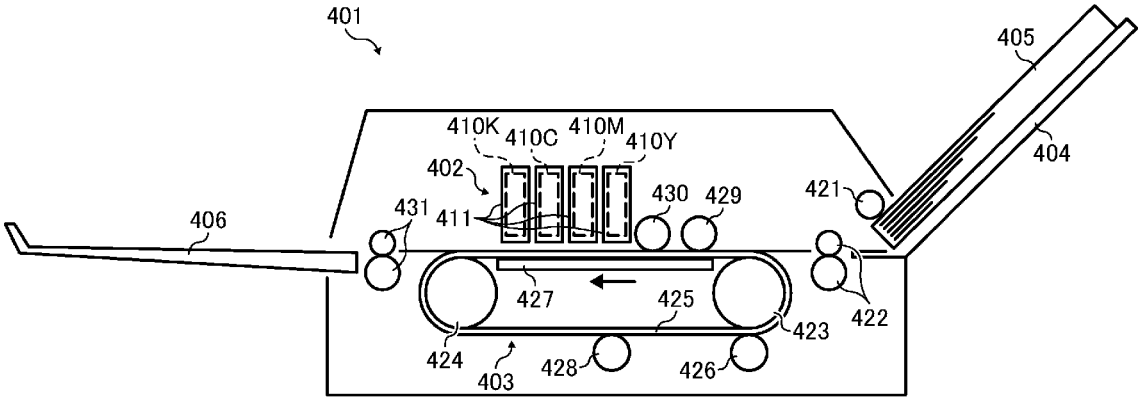
FIG. 3 is a schematic view of an image forming apparatus according to another exemplary embodiment.

Referring to FIG. 3, the following describes an image forming apparatus 401 according to another exemplary embodiment. As illustrated in FIG. 3, the image forming apparatus 401 includes a paper tray 404, a feeding roller 421, a sheet supply roller pair 422, an image forming device 402, a conveying mechanism 403, an output roller pair 431, and an output tray 406. The image forming device 402 includes line-type recording heads 410Y, 410M, 410C, and 410K and liquid tanks 411. The conveying mechanism 403 includes a conveying belt 425, a driving roller 423, a driven roller 424, a charging roller 426, a guide 427, a cleaning roller 428, a discharging roller 429, and a pressing roller 430.

The image forming apparatus 401 can be any of a copying machine, a printer, a facsimile machine, a plotter, and a multifunction printer including copying, printing, scanning, and facsimile functions. In this non-limiting exemplary embodiment, the image forming apparatus 401 functions as a line type image forming apparatus for forming an image on a recording medium. The image forming apparatus 401 includes a full-line type recording head.

The paper tray 404 is attached to one side of the image forming apparatus 401, and loads a recording medium (e.g., a plurality of sheets 405), which is not limited to paper. The feeding roller 421 separates an uppermost sheet 405 from the other sheets 405 placed in the paper tray 404 to feed the sheets 405 one by one towards the sheet supply roller pair 422. The sheet supply roller pair 422 feeds the sheet 405 towards the conveying mechanism 403.

The image forming device 402, serving as a liquid discharging device, discharges a liquid drop to form an image on the sheet 405 while the conveying mechanism 403 conveys the sheet 405. In the image forming device 402, the liquid tanks 411 for containing liquid are integrated with the line-type recording heads 410Y, 410M, 410C, and 410K. The line-type recording heads 410Y, 410M, 410C, and 410K, serving as liquid discharging heads, include a row of nozzles having a width equivalent to a width of the sheet 405 in a main scanning direction (e.g., a direction perpendicular to a sheet conveyance direction). The line-type recording heads 410Y, 410M, 410C, and 410K are attached to a head holder (not shown).

For example, the line-type recording heads 410Y, 410M, 410C, and 410K are arranged in this order in the sheet conveyance direction, and discharge yellow, magenta, cyan, and black liquid drops, respectively. The line-type recording heads 410Y, 410M, 410C, and 410K may include a single recording head including a plurality of nozzles for discharging yellow, magenta, cyan, and black liquid drops arranged in a manner that a predetermined distance is provided between the nozzles. The line-type recording heads 410Y, 410M, 410C, and 410K may not be integrated with liquid tanks (e.g., the liquid tanks 411) or liquid cartridges. According to this non-limiting exemplary embodiment, the liquid discharging device (e.g., the image forming device 402) includes the line-type recording heads 410Y, 410M, 410C, and 410K and the liquid tanks 411. However, the liquid discharging device may not include the liquid tanks 411 or may include an element other than the liquid tanks 411.

In the conveying mechanism 403, the conveying belt 425 is looped over the driving roller 423 and the driven roller 424. The charging roller 426 charges the conveying belt 425. The guide 427 (e.g., a platen plate) guides the conveying belt 425 at a position in which the conveying belt 425 opposes the image forming device 402. The cleaning roller 428 includes a porous body and removes liquid (e.g., ink) adhered to the conveying belt 425. The discharging roller 429 includes a conductive rubber and discharges the sheet 405. The pressing roller 430 presses the sheet 405 onto the conveying belt 425.

The output roller pair 431 is provided downstream from the conveying mechanism 403 in the sheet conveyance direction. The output roller pair 431 feeds the sheet 405 bearing the image onto the output tray 406. The output tray 406 is attached to another side of the image forming apparatus 401, and receives the sheet 405 fed by the output roller pair 431.

In the line-type image forming apparatus 401, the sheet 405 is fed onto the charged conveying belt 425. The conveying belt 425 electrostatically attracts the sheet 405. While the rotating conveying belt 425 conveys the sheet 405, the image forming device 402 forms an image on the sheet 405. The sheet 405 bearing the image is output onto the output tray 406.

Referring to FIGS. 4 to 9, the following describes a liquid discharging head 100 according to an exemplary embodiment. The liquid discharging head 100 may be the recording-head 234 included in the image forming apparatus 200 (depicted in FIG. 1) or the line-type recording head 410Y, 410M, 410C, or 410K included in the image forming apparatus 401 (depicted in FIG. 3).

Figure 4:
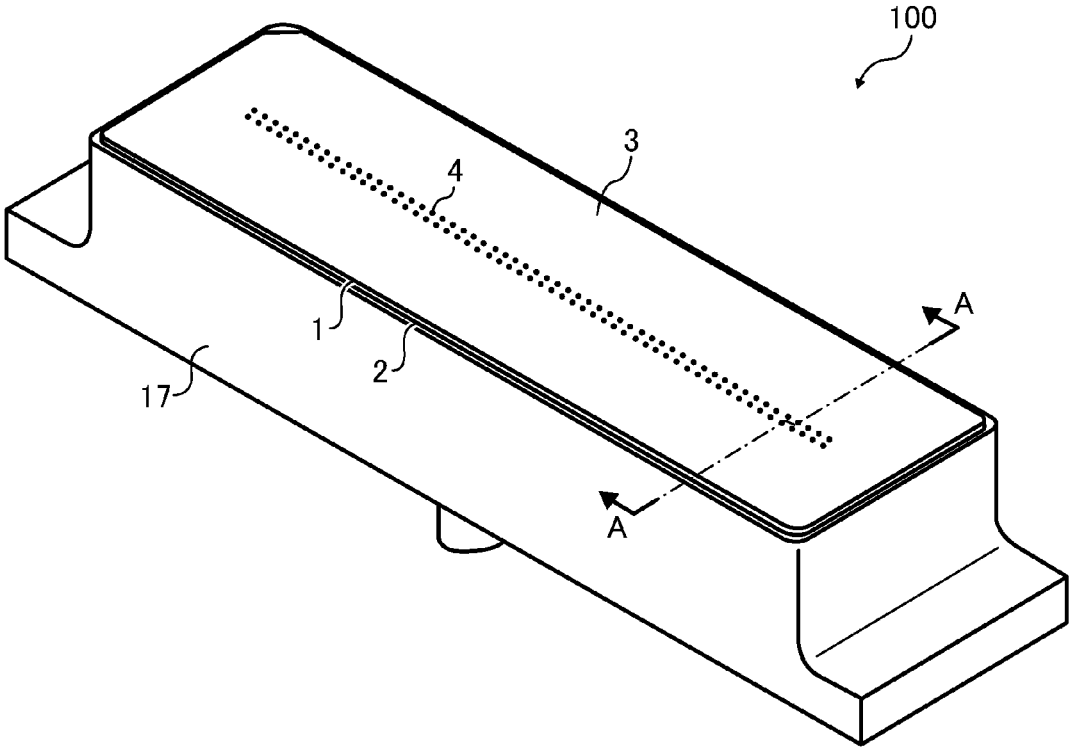
FIG. 4 is an external perspective view of a liquid discharging head included in the image forming apparatus shown in FIGS. 1 to 3.

FIG. 4 is an external perspective view of the liquid discharging head 100. As illustrated in FIG. 4, the liquid discharging head 100 includes a base plate 1, a vibration plate 2, a nozzle plate 3, a nozzle 4, and a frame 17.

The base plate 1 (e.g., a liquid chamber plate or a flow route plate) includes a SUS plate. The vibration plate 2 is attached to a bottom surface of the base plate 1. The nozzle plate 3 is attached to a top surface of the base plate 1. The nozzle 4 discharges a liquid drop. The frame 17 is adhered around the vibration plate 2 with an adhesive.

Figure 5:
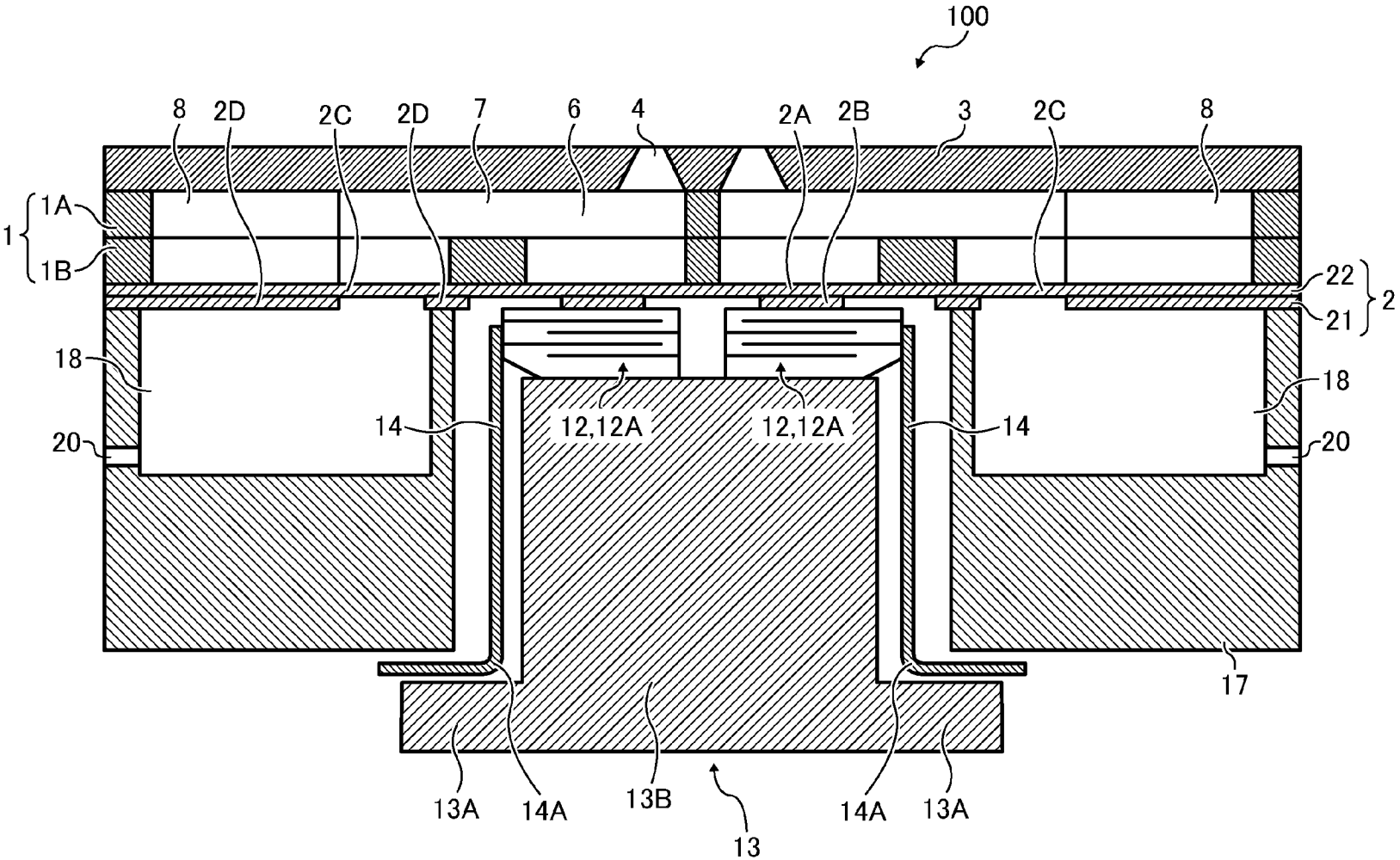
FIG. 5 is a sectional view of the liquid discharging head taken on line A-A of FIG. 4.

FIG. 5 is a sectional view of the liquid discharging head 100 taken on line A-A of FIG. 4. As illustrated in FIG. 5, the liquid discharging head 100 further includes a pressing liquid chamber 6, a fluid resistance portion 7, a shared liquid chamber 8, a piezoelectric element member 12A, a base 13, an FPC (flexible printed circuit) cable 14, a diaphragm 2C, a buffer chamber 18, and a connecting route 20. The piezoelectric element member 12A includes a piezoelectric element 12. The base 13 includes a projecting portion 13A and a wide portion 13B. The FPC cable 14 includes a bend portion 14A. The base plate 1 includes a restrictor plate 1A and a chamber plate 1B. The vibration plate 2 includes a metal member 21 and a resin member 22. The metal member 21 includes an island protrusion 2B and a thick portion 2D. The resin member 22 includes a vibration plate area 2A.

Figure 6:
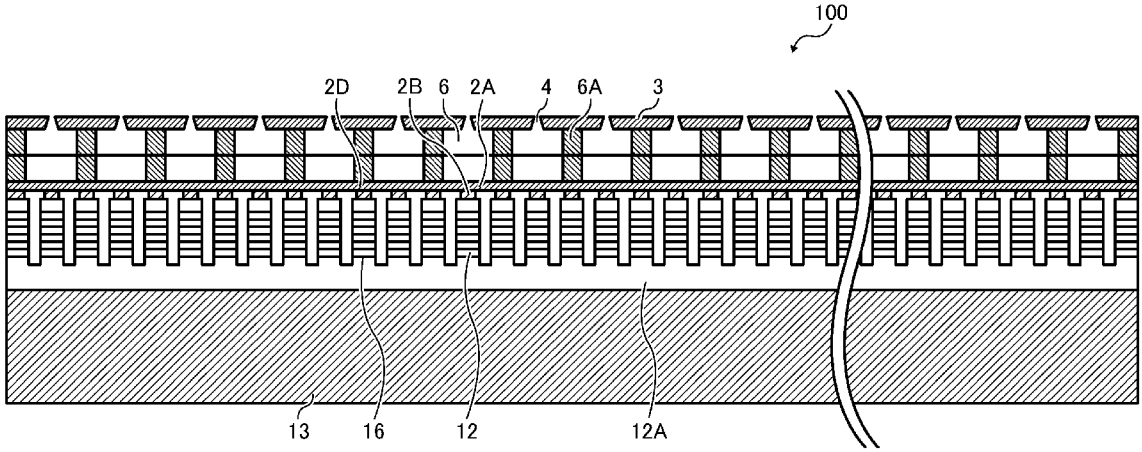
FIG. 6 is a sectional view of the liquid discharging head taken on line perpendicular to line A-A of FIG. 4.

FIG. 6 is a sectional view of the liquid discharging head 100 taken on line perpendicular to line A-A of FIG. 4. The line perpendicular to line A-A corresponds to a direction in which the pressing liquid chambers 6 are arranged or to a direction perpendicular to the longitudinal direction of the pressing liquid chamber 6. As illustrated in FIG. 6, the pressing liquid chamber 6 includes a wall 6A. The piezoelectric element 12 includes a column 16.

Figure 7:
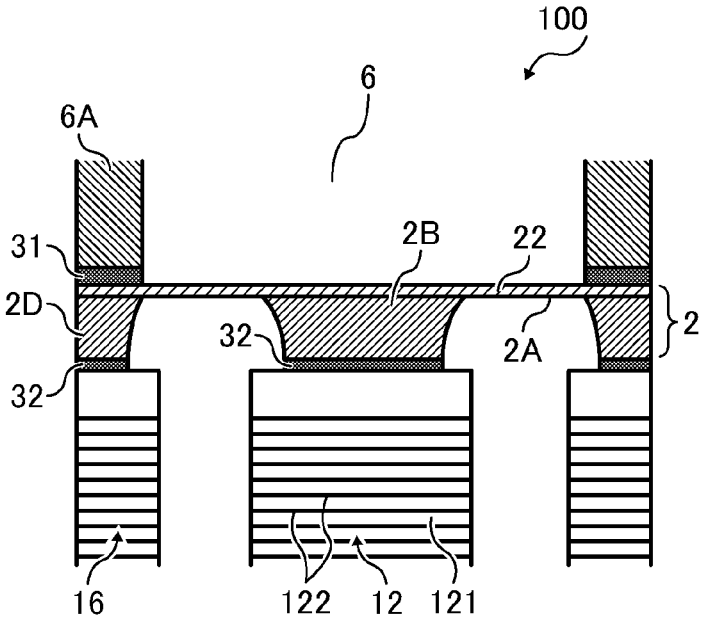
FIG. 7 is an enlarged sectional view of the liquid discharging head shown in FIG. 6 for illustrating one pressing liquid chamber and elements provided near the pressing liquid chamber.

FIG. 7 is an enlarged sectional view of the liquid discharging head 100 for illustrating one pressing liquid chamber 6 and elements provided near the pressing liquid chamber 6. As illustrated in FIG. 7, the liquid discharging head 100 further includes adhesives 31 and 32. The piezoelectric element 12 further includes a piezoelectric layer 121 and an internal electrode layer 122.

As illustrated in FIG. 5, the base plate 1, the vibration plate 2, and the nozzle plate 3 form the pressing liquid chamber 6, the fluid resistance portion 7, and the shared liquid chamber 8. The pressing liquid chamber 6 (e.g., a liquid chamber, a pressure chamber, a pressing chamber, or a flow route) contains liquid (e.g., ink). The nozzle 4 is connected to the pressing liquid chamber 6. The fluid resistance portion 7 supplies liquid to the pressing liquid chamber 6. The shared liquid chamber 8 supplies liquid to a plurality of pressing liquid chambers 6. A liquid tank (not shown) supplies liquid to the shared liquid chamber 8 via a supply route (not shown).

The restrictor plate 1A and the chamber plate 1B are attached to each other to form the base plate 1. In the base plate 1, the SUS plate is etched with an acid etching liquid or is mechanically processed (e.g., stamped) to form openings such as the pressing liquid chamber 6, the fluid resistance portion 7, and the shared liquid chamber 8. For example, the fluid resistance portion 7 is formed by forming an opening in a part of the restrictor plate 1A and not forming an opening in a part of the chamber plate 1B.

The vibration plate 2 is attached to the chamber plate 1B. The resin member 22 is directly coated on the metal member 21 to form the vibration plate 2. The metal member 21 includes a SUS base plate. A resin prepared to have a greater linear expansion coefficient than the metal member 21 is directly applied on the metal member 21, and is heated and solidified to form the resin member 22 (e.g., a resin layer). The vibration plate area 2A is included in the resin member 22, and forms a deformable wall of the pressing liquid chamber 6. The island protrusion 2B (e.g., an island convex) is included in the metal member 21, and is provided on a surface of the vibration plate area 2A opposite to a surface facing the pressing liquid chamber 6.

The wall 6A (depicted in FIG. 6) is formed of the base plate 1. The thick portion 2D is formed of the metal member 21, and is provided at a position corresponding to the wall 6A. Alternatively, the vibration plate 2 may be formed of a resin member and a metal member adhered to each other with an adhesive, or may be electroformed with nickel.

When the chamber plate 1B forming the fluid resistance portion 7 is attached to the resin member 22 of the vibration plate 2, pressure in the pressing liquid chamber 6 may not be released to outside via the resin member 22 including a thin polyimide. Thus, the liquid discharging head 100 may effectively discharge a liquid drop.

As illustrated in FIG. 6, the nozzle plate 3 forms a plurality of nozzles 4 corresponding to a plurality of pressing liquid chambers 6. The nozzle 4 has a diameter of about 10 μm to about 30 μm. The nozzle plate 3 is adhered to the restrictor plate 1A of the base plate 1 (depicted in FIG. 5) with an adhesive. The nozzle plate 3 may include a metal (e.g., stainless steel, nickel, and/or the like), a resin (e.g., polyimide resin film), silicon, and a mixture of the above. A water-repellent film is formed on a discharging surface of the nozzle 4 by a known method such as plating or coating with a repellent so as to provide water repellency against ink.

As illustrated in FIG. 5, the piezoelectric element 12 includes a laminated piezoelectric element and serves as a pressure generator or an actuator. The piezoelectric element 12 is attached to the island protrusion 2B. The piezoelectric element 12 opposes an outer surface (e.g., a surface provided on an opposite side of a surface facing the pressing liquid chamber 6) of the vibration plate 2 via the island protrusion 2B. The piezoelectric element 12 is provided to correspond to the pressing liquid chamber 6. The piezoelectric element 12 is also attached to the base 13.

As illustrated in FIG. 6, a single piezoelectric element member 12A is half cut by groove or slit processing to form a plurality of piezoelectric elements 12. The piezoelectric element member 12A is fixed on the base 13 along a direction in which the plurality of piezoelectric elements 12 is arranged. As illustrated in FIG. 5, in the base 13, the projecting portion 13A projects or protrudes to form the wide portion 138. The FPC cable 14 is connected to one end surface of the piezoelectric element 12 to provide a driving waveform. In this case, the plurality of piezoelectric elements 12 arranged in a line includes piezoelectric elements (e.g., piezoelectric elements 12) which are driven and piezoelectric elements (e.g., the columns 16) which are not driven, as illustrated in FIG. 6. The driven piezoelectric elements and the non-driven piezoelectric elements are disposed alternately. The bend portion 14A of the FPC cable 14 is bent.

As illustrated in FIG. 7, the wall 6A is adhered to the resin member 22 of the vibration plate 2 with the adhesive 31. The driven piezoelectric element 12 is adhered to the island protrusion 28 with the adhesive 32. The non-driven piezoelectric element (e.g., the column 16) is adhered to the thick portion 2D corresponding to the wall 6A with the adhesive 32.

In the piezoelectric element 12, the piezoelectric layer 121 and the internal electrode layer 122 are layered alternately. The piezoelectric layer 121 has a thickness of about 10 μM to about 50 μm each, and includes lead zirconate titanate (PZT). The internal electrode layer 122 has a thickness of several micrometers each, and includes argent palladium (AgPd). The internal electrode layers 122 are electrically connected to an individual electrode (not shown) and a shared electrode (not shown) alternately. The individual electrode and the shared electrode serve as end electrodes or external electrodes. The piezoelectric element 12 has a piezoelectric constant d33 indicating expansion and contraction in a direction perpendicular to a surface of the internal electrode layer 122 or a thickness direction of the internal electrode layer 122. Expansion and contraction of the piezoelectric element 12 displaces the vibration plate area 2A to expand and contract the pressing liquid chamber 6. When a driving signal is applied to charge the piezoelectric element 12, the pressing liquid chamber 6 expands. When the piezoelectric element 12 is discharged, the pressing liquid chamber 6 contracts in a direction opposite to a direction in which the pressing liquid chamber 6 expands.

According to this non-limiting exemplary embodiment, the piezoelectric element 12 is displaced in a direction d33 to apply pressure to ink in the pressing liquid chamber 6. However, the piezoelectric element 12 may be displaced in a direction d31, that is, a direction parallel to the surface of the internal electrode layer 122.

The base 13 (depicted in FIG. 6) may preferably include a metal material (e.g., stainless steel) to prevent the piezoelectric element 12 from storing heat generated by the piezoelectric element 12. When the base 13 has a great linear expansion coefficient, an adhesive for adhering the piezoelectric element 12 to the base 13 may peel off from an interface between the piezoelectric element 12 and the base 13 at a high or low temperature. When the piezoelectric element 12 does not have a long length, the piezoelectric element 12 may not separate from the base 13 even when an environmental temperature changes. However, when the piezoelectric element 12 includes about 400 nozzles in a manner that a gap of about 300 dpi is provided between the adjacent piezoelectric elements 12, each piezoelectric element 12 has a length of about 30 mm to about 40 mm or greater. As a result, the piezoelectric element 12 may easily separate from the base 13. Therefore, the base 13 may preferably include a material having a linear expansion coefficient of about 10E-6/° C. or smaller. Specifically, when parts adhered to the piezoelectric element 12 have a linear expansion coefficient of about 10E-6/° C. or smaller, separation of the piezoelectric element 12 from the base 13 may be effectively prevented. For example, the parts adhered to the piezoelectric element 12 may include a stainless steel plate.

As illustrated in FIG. 5, the frame 17 is adhered to a circumferential portion of the vibration plate 2 with an adhesive. The diaphragm 2C is formed of the resin member 22 of the vibration plate 2, and is deformable. The buffer chamber 18 is formed of the frame 17, and is provided adjacent to the shared liquid chamber 8 via the diaphragm 2C. The diaphragm 2C forms a wall of the shared liquid chamber 8 and the buffer chamber 18. Air enters or goes out of the buffer chamber 18 via the connecting route 20.

The liquid discharging head 100 includes two rows of the piezoelectric elements 12 opposing each other in a manner that a gap of about 300 dpi is provided between the adjacent piezoelectric elements 12. The liquid discharging head 100 includes two rows of the pressing liquid chambers 6 and the nozzles 4 staggered in a manner that a gap of about 150 dpi is provided between the adjacent pressing liquid chambers 6 and the adjacent nozzles 4. Thus, the liquid discharging head 100 provides a resolution of about 300 dpi for a single scan. A row of piezoelectric elements 12 includes the driven piezoelectric elements and the non-driven piezoelectric elements (e.g., the columns 16 depicted in FIG. 6) alternately arranged.

As described above, most of the elements included in the liquid discharging head 100 include SUS. Thus, the elements included in the liquid discharging head 100 have a common thermal expansion coefficient, preventing or reducing problems caused by thermal expansion of the elements when the liquid discharging head 100 is manufactured or used.

In the liquid discharging head 100 having the above-described structure, when a voltage applied to the piezoelectric element 12 is decreased from a reference electric potential, the piezoelectric element 12 is contracted to lower the vibration plate 2. Accordingly, the volume of the pressing liquid chamber 6 is increased, and ink is flown into the pressing liquid chamber 6. Then, a voltage applied to the piezoelectric element 12 is increased to expand the piezoelectric element 12 in a layered direction in which the piezoelectric layer 121 and the internal electrode layer 122 (depicted in FIG. 7) are layered. The vibration plate 2 is deformed. For example, the vibration plate 2 is pressed towards the nozzle 4. Accordingly, the volume of the pressing liquid chamber 6 is decreased to apply pressure to ink in the pressing liquid chamber 6. Thus, an ink drop is discharged (e.g., ejected) from the nozzle 4.

When the voltage applied to the piezoelectric element 12 is returned to the reference electric potential, the vibration plate 2 returns to the original position. Accordingly, the volume of the pressing liquid chamber 6 is expanded to generate a negative pressure. Ink is flown from the shared liquid chamber 8 to fill the pressing liquid chamber 6. Vibration of a meniscus surface of the nozzle 4 is damped and stabilized to start a next liquid drop discharging operation.

The method for driving the liquid discharging head 100 is not limited to the above-described example for decreasing and increasing the volume of the pressing liquid chamber 6. The volume of the pressing liquid chamber 6 may be decreased and increased by changing application of a driving waveform.

Figure 8:
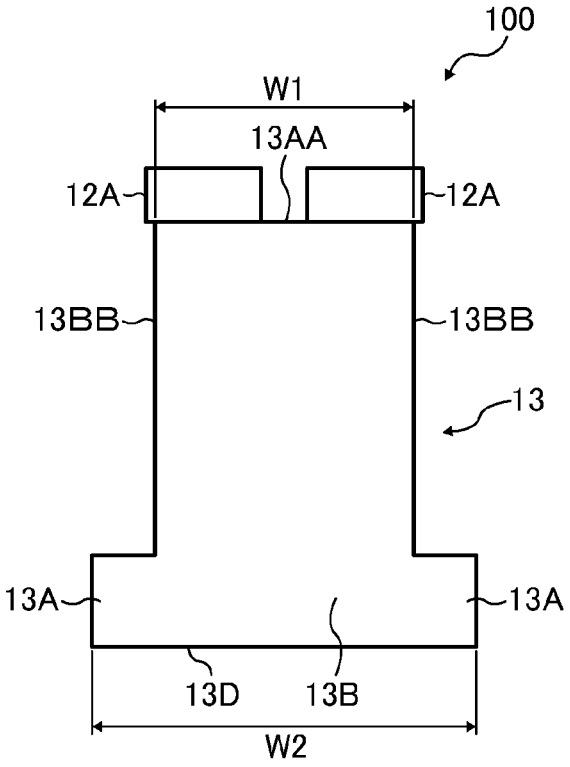
FIG. 8 is a side view of a base included in the liquid discharging head shown in FIG. 6.

Referring to FIG. 8, the following describes the base 13 of the liquid discharging head 100 in detail. FIG. 8 is a side view of the base 13. Namely, FIG. 8 illustrates the base 13 in a direction perpendicular to a longitudinal direction of the base 13, that is, a direction corresponding to a shorter length of the base 13 or a direction perpendicular to a direction in which the nozzles 4 (depicted in FIG. 6) are arranged.

As illustrated in FIG. 8, the base 13 further includes an adhering surface 13AA, edge surfaces 13BB, and an opposite surface 13D.

A plurality of piezoelectric element members 12A, serving as energy generators, is disposed on the adhering surface 13AA (e.g., an attach surface). The adhering surface 13AA has a shorter width W1 in a short direction of the base 13 (e.g., the direction perpendicular to the longitudinal direction of the base 13). The wide portion 13B has a longer width W2, which is longer than the shorter width W1, in the short direction of the base 13. Specifically, the edge surfaces 13BB are perpendicular to the adhering surface 13AA. A part of each of the edge surfaces 13BB projects outward to form the projecting portions 13A. The projecting portions 13A form the wide portion 13B.

The opposite surface 13D is provided opposite to the adhering surface 13AA. The projecting portions 13A, which form the wide portion 13B, include a surface which is included in the opposite surface 13D. The opposite surface 13D has the longer width W2, which is longer than the shorter width W1 of the adhering surface 13AA. Thus, the base 13 has a substantially cruciform shape in a cross-section along the short direction of the base 13. For example, the base 13 has an inverted T-section.

As described above, a plurality of energy generators (e.g., the piezoelectric element members 12A) is disposed on a base (e.g., the base 13) in a longitudinal direction of the base. A part of edge surfaces (e.g., the edge surfaces 13BB) in a short direction of the base projects from the edge surfaces to form projecting portions (e.g., the projecting portions 13A). The projecting portions form a wide portion (e.g., the wide portion 13B). The wide portion has a longer width (e.g., the longer width W2) in the short direction of the base. The longer width of the wide portion is longer than a shorter width (e.g., the shorter width W1) of a surface (e.g., the adhering surface 13AA) on which the energy generators are disposed. Therefore, warp of the base may be reduced without increasing the whole length or the whole width of the base. As a result, a liquid discharging head (e.g., the liquid discharging head 100) having a longer size may be manufactured at low costs.

The adhering surface 13AA, to which the piezoelectric element members 12A or the piezoelectric elements 12 (depicted in FIG. 6) are adhered, needs to have a desired flatness. When the adhering surface 13AA is processed to have the desired flatness, the adhering surface 13AA is susceptible to heat distortion during processing, when the base 13 is excessively warped. When the base 13 has a decreased flexural rigidity, the adhering surface 13AA is also susceptible to heat distortion during processing.

Figure 9A:
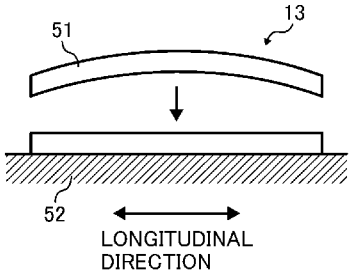
FIGS. 9A to 9F illustrate warp of the base shown in FIG. 8.
Figure 9B:
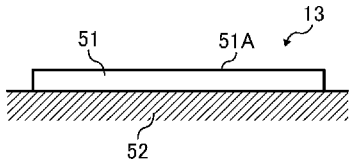
Figure 9C:
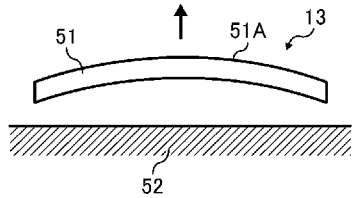
Figure 9D:
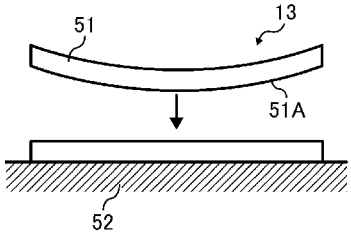
Figure 9E:
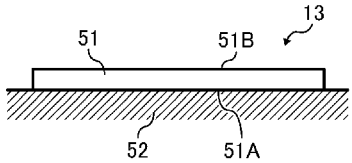
Figure 9F:
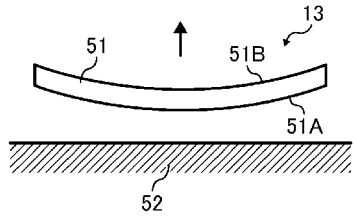

When the base 13 has a decreased flexural rigidity, the adhering surface 13AA may not be processed to have a flat surface. Referring to FIGS. 9A to 9F, the following describes the base 13 having a decreased flexural rigidity. As illustrated in FIG. 9A, the base 13 includes a material 51 having a decreased flexural rigidity and being warped. As illustrated in FIG. 9A, when the warped material 51 is placed on a processing base 52 by magnetic absorption, the material 51 is flattened on the processing base 52. As illustrated in FIG. 9B, the material 51 includes a first surface 51A which does not contact the processing base 52. When flattening processing is performed on the first surface 51A of the material 51, the first surface 51A maintains flatness while the material 51 is placed on the processing base 52. However, when the material 51 is separated from the processing base 52 after flattening processing, the material 51 is warped again and the first surface 51A may not maintain flatness as illustrated in FIG. 9C. As illustrated in FIG. 9D, when the warped material 51 is placed on the processing base 52 in a manner that the processed first surface 51A contacts the processing base 52, the material 51 is flattened on the processing base 52. As illustrated in FIG. 9E, the material 51 further includes a second surface 51B provided on an opposite side of the first surface 51A. When flattening processing is performed on the second surface 51B of the material 51, the second surface 51B maintains flatness while the material 51 is placed on the processing base 52. However, when the material 51 is separated from the processing base 52 after flattening processing, the material 51 is warped again and the second surface 51B may not maintain flatness as illustrated in FIG. 9F. Even when the material 51 is placed on the processing base 52 in a state that the material 51 is warped, a gap may be partially formed between the processing base 52 and the material 51. When a pressure for flattening processing is applied on the material 51 to remove the gap, the material 51 is flattened on the processing base 52, and the above-described problems may occur.

To prevent the above-described problems, the base 13 needs to have a strength overcoming a force and a pressure applied to the base 13 during flattening processing. For example, the base 13 may have an increased cross-sectional area so that the base 13 is not susceptible to heat distortion and initial warp. Specifically, the flexural rigidity of the base 13 may be increased (e.g., cubed) in accordance with a length of a direction in which the piezoelectric element members 12A are adhered or attached to the adhering surface 13AA (depicted in FIG. 8).

As illustrated in FIG. 6, the piezoelectric element 12 including the piezoelectric element member 12A adhered to the base 13 may have a limited height. Therefore, the base 13 may not have an increased height. When the base 13 has an increased width overall in the short direction of the base 13, the liquid discharging head 100 may have a large size.

As illustrated in FIG. 8, in the liquid discharging head 100 according to this non-limiting exemplary embodiment, the base 13 has an increased cross-sectional area in a direction parallel to the adhering surface 13AA to which the piezoelectric element members 12A are adhered, so that the base 13 has an increased flexural rigidity and suppressed height and width. The base 13 includes the wide portion 13B having a width longer than the width of the adhering surface 13AA, on which the piezoelectric element members 12A are disposed, in the short direction of the base 13. Thus, warp of the base 13 may be reduced without increasing the size of the liquid discharging head 100. Namely, the liquid discharging head 100 having a longer size may be manufactured at low costs.

Figure 10:
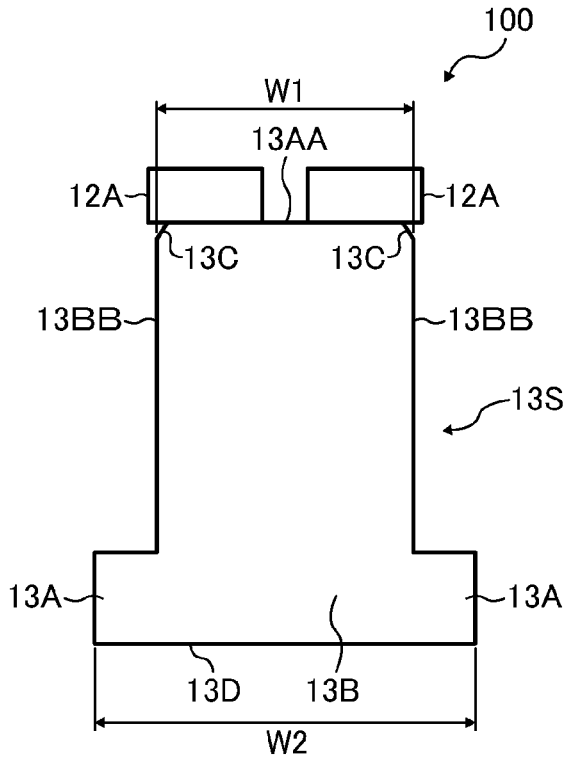
FIG. 10 is a side view of a modified version of the base shown in FIG. 8.

FIG. 10 illustrates a base 13S as a modified version of the base 13 (depicted in FIG. 8). As illustrated in FIG. 10, the base 13S includes chamfers 13C. The other elements of the base 13S are common to the base 13. The chamfers 13C are provided on edges of the adhering surface 13AA in a short direction of the base 13S. When the chamfers 13C are formed on the adhering surface 13AA, the shorter width W1 of the adhering surface 13AA includes a width of the chamfers 13C in the short direction of the base 13S.

Figure 11:
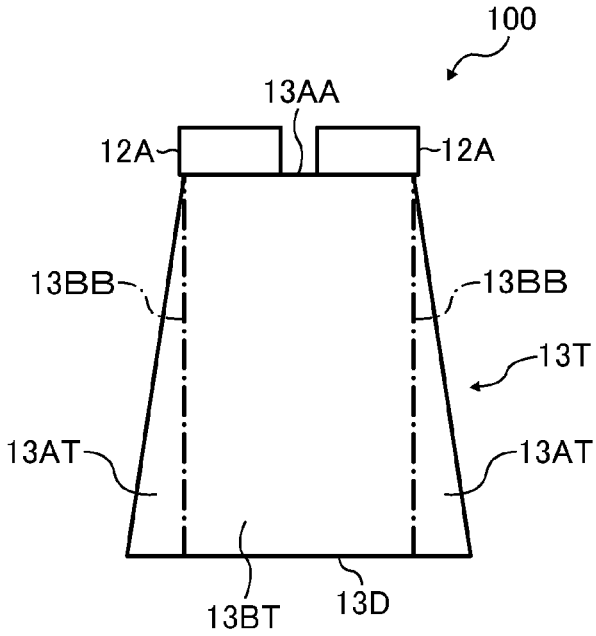
FIG. 11 is a side view of one example of the base shown in FIG. 8.
Figure 12:
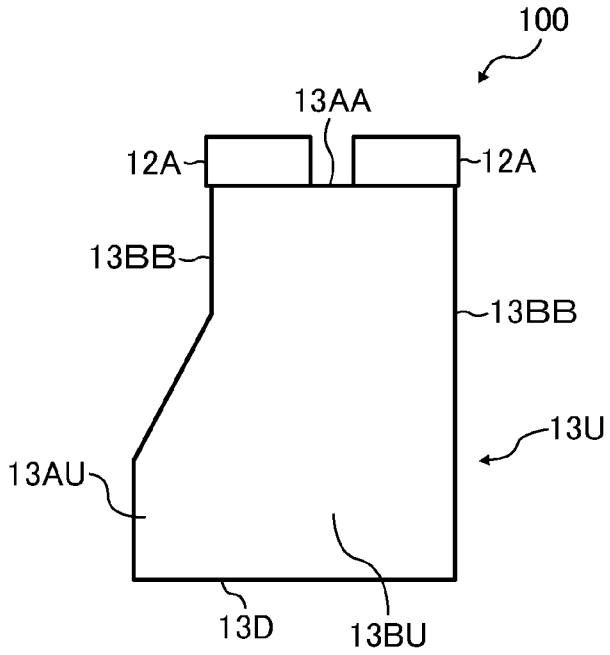
FIG. 12 is a side view of another example of the base shown in FIG. 8.
Figure 13:
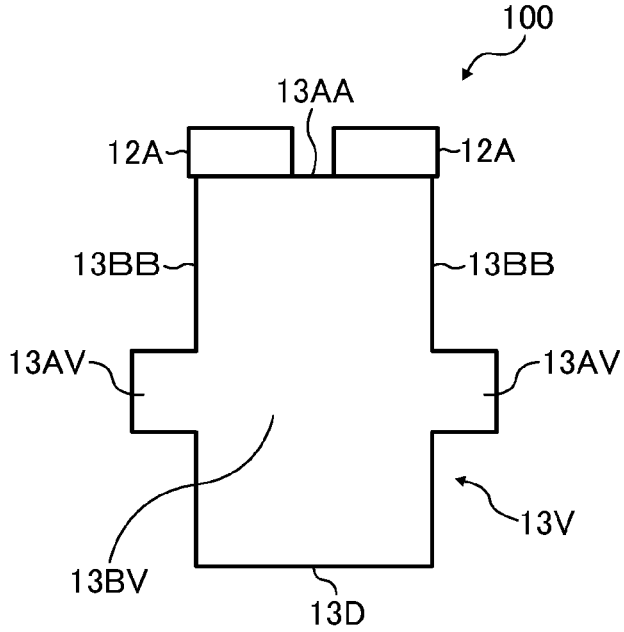
FIG. 13 is a side view of yet another example of the base shown in FIG. 8.

The shape of the projecting portion 13A of the base 13 is not limited to the shape illustrated in FIG. 8. FIGS. 11 to 13 illustrate other shapes of the projecting portion 13A.

FIG. 11 illustrates a base 13T having an exemplary shape. As illustrated in FIG. 11, the base 13T includes projecting portions 13AT and a wide portion 13BT. The other elements of the base 13T are common to the base 13 (depicted in FIG. 8) or the base 13S (depicted in FIG. 10). The base 13T has a substantially trapezoidal shape in a cross-section along a short direction of the base 13T. For example, the base 13T has a trapezoidal cross-section. The base 13T includes the projecting portions 13AT shaping the base 13T to have the trapezoidal cross-section. The projecting portions 13AT form the wide portion 13BT having a width longer than the width of the adhering surface 13AA. Accordingly, the opposite surface 13D has a width longer than the width of the adhering surface 13AA to which the piezoelectric element members 12A are adhered.

FIG. 12 illustrates a base 13U having another exemplary shape. As illustrated in FIG. 12, the base 13U includes a projecting portion 13AU and a wide portion 13BU. The other elements of the base 13U are common to the base 13 (depicted in FIG. 8) or the base 13S (depicted in FIG. 10). As illustrated in FIG. 12, the base 13U includes the projecting portion 13AU provided on one of the edge surfaces 13BB. The projecting portion 13AU forms the wide portion 13BU having a width longer than the width of the adhering surface 13AA. Accordingly, the opposite surface 13D has a width longer than the width of the adhering surface 13AA to which the piezoelectric element members 12A are adhered.

FIG. 13 illustrates a base 13V having yet another exemplary shape. As illustrated in FIG. 13, the base 13V includes projecting portions 13AV and a wide portion 13BV. The other elements of the base 13V are common to the base 13 (depicted in FIG. 8) or the base 13S (depicted in FIG. 10). The base 13V includes the projecting portions 13AV provided on middle portions of the edge surfaces 13BB, respectively, in a height direction of the base 13V. The projecting portions 13AV form the wide portion 13BV having a width longer than the width of the adhering surface 13AA at the middle portions of the edge surfaces 13BB in the height direction of the base 13V. Accordingly, the opposite surface 13D has a width substantially common to the width of the adhering surface 13AA to which the piezoelectric element members 12A are adhered. Thus, the base 13V has a cross-like shape in cross-section.

Figure 14:
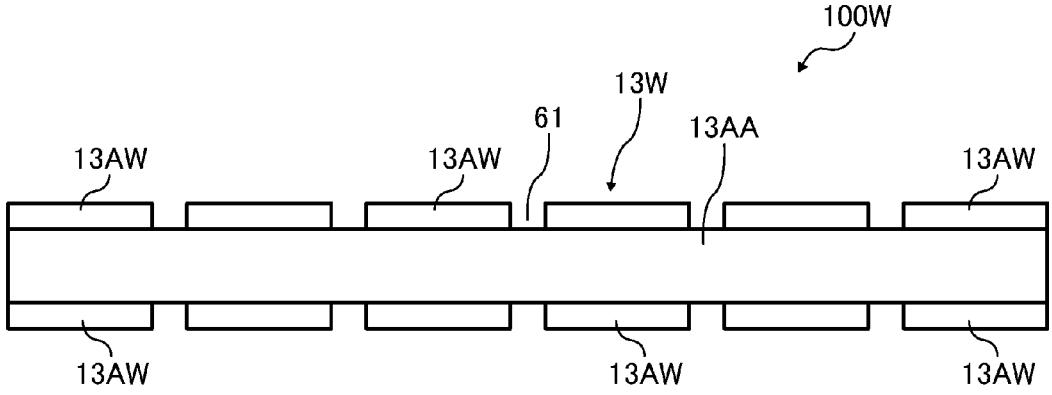
FIG. 14 is a plane view of a base included in a liquid discharging head according to another exemplary embodiment.

Referring to FIG. 14, the following describes a liquid discharging head 100W according to another exemplary embodiment. FIG. 14 is a plane view of a base 13W of the liquid discharging head 100W. The liquid discharging head 100W includes the base 13W instead of the base 13 (depicted in FIG. 8). The base 13W includes projecting portions 13AW and a slit 61. The other elements of the liquid discharging head 100W are common to the liquid discharging head 100 (depicted in FIG. 8 or 10).

The projecting portions 13AW are provided non-sequentially on both edge surfaces of the base 13W in a short direction of the base 13W. The slit 61 is provided in a gap between the adjacent projecting portions 13AW in a longitudinal direction of the base 13W.

The FPC cable 14 (depicted in FIG. 5) may be held straight in the slit 61 or may be threaded straight through the slit 61. Specifically, when the projecting portions 13AW are provided sequentially on the base 13W along the longitudinal direction of the base 13W, the bend portion 14A of the FPC cable 14 is bent as illustrated in FIG. 5. On the contrary, when the slip 61 is provided, the FPC cable 14 may be set straight without being bent.

When the projecting portions 13AW are arranged non-sequentially, warp of the base 13W may not be reduced relatively as effectively as a base (e.g., the base 13 depicted in FIG. 8) in which the projecting portions 13A are arranged sequentially. However, warp of the base 13W may be practically reduced.

Figure 15:
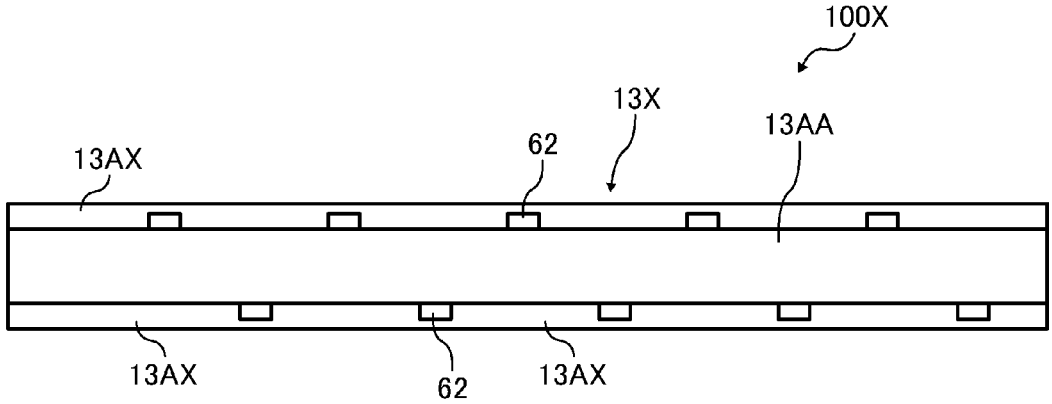
FIG. 15 is a plane view of a modified version of the base shown in FIG. 14.
Figure 16:
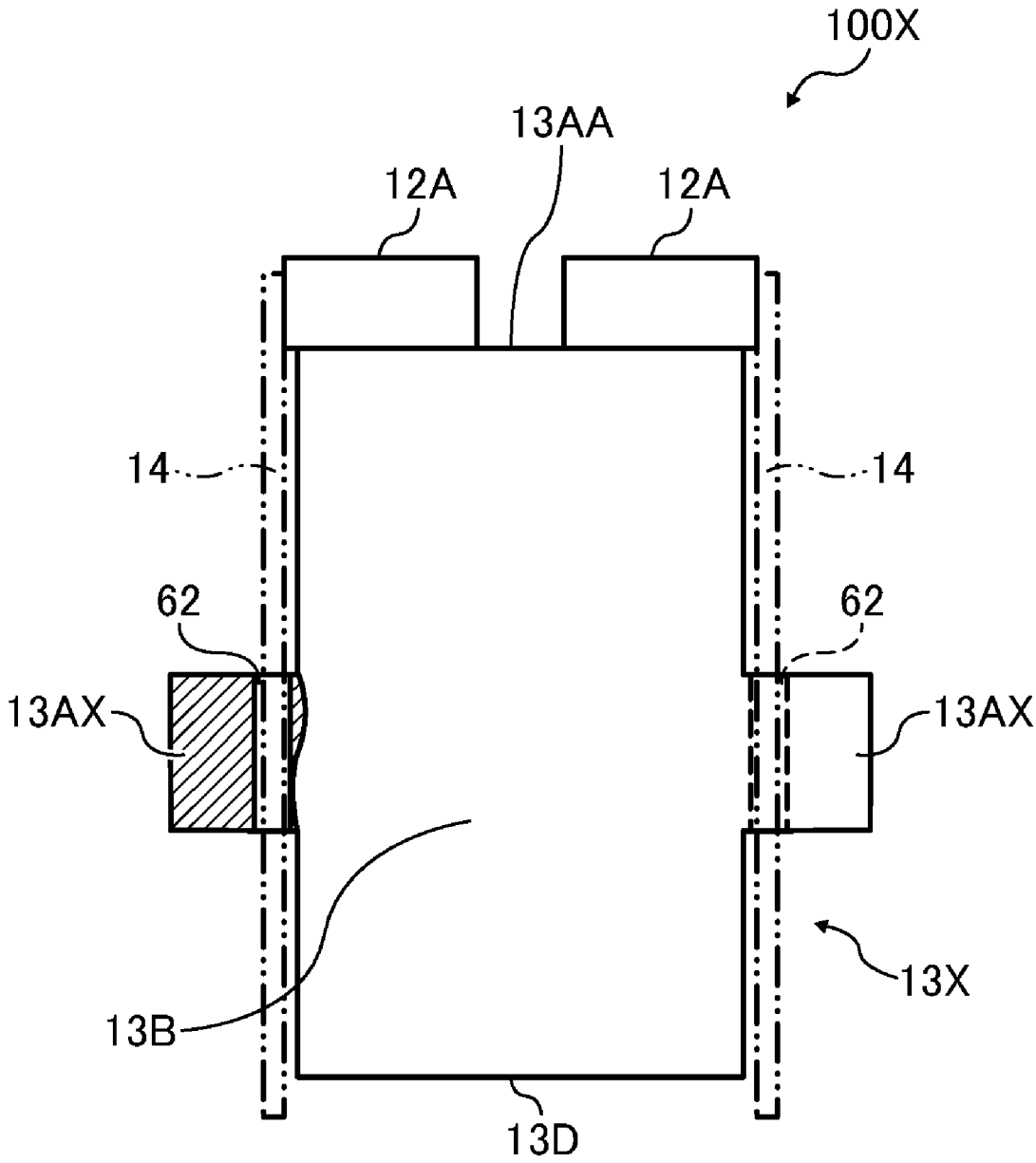
FIG. 16 is a side view of the base shown in FIG. 15.

Referring to FIGS. 15 and 16, the following describes a liquid discharging head 100X according to yet another exemplary embodiment. FIG. 15 is a plane view of a base 13X of the liquid discharging head 100X. FIG. 16 is a side view of the base 13X of the liquid discharging head 100X. The liquid discharging head 10X includes the base 13X instead of the base 13 (depicted in FIG. 8). The base 13X includes projecting portions 13AX and holes 62. The other elements of the liquid discharging head 100X are common to the liquid discharging head 100 (depicted in FIG. 8 or 10).

The projecting portions 13AX are provided sequentially on both edge surfaces of the base 13X in a short direction of the base 13X. The holes 62 are provided in the projecting portions 13AX. For example, the holes 62 provided in the opposing projecting portions 13AX are staggered with each other. The FPC cable 14 (depicted in FIG. 5) is threaded through the hole 62.

Like the slit 61 (depicted in FIG. 14), the hole 62 may hold the FPC cable 14. Further, in the liquid discharging head 100X, warp of the base 13X may be suppressed more effectively than in the liquid discharging head 100W (depicted in FIG. 14).

According to the above-described exemplary embodiments, the piezoelectric element members 12A are attached to the base (e.g., the base 13, 13S, 13T, 13U, 13V, 13W, or 13X depicted in FIG. 8, 10, 11, 12, 13, 14, or 16, respectively). However, the above-described exemplary embodiments may also be applied to a liquid discharging head in which a plurality of boards including a thermal conversion element (e.g., a heater element) is adhered on a base.

In a liquid discharging head (e.g., the liquid discharging head 100, 100W, or 100X depicted in FIG. 8, 14, or 15, respectively) according to the above-described exemplary embodiments, a plurality of energy generators (e.g., the piezoelectric element members 12A depicted in FIG. 8) is disposed on a base (e.g., the base 13, 13S, 13T, 13U, 13V, 13W, or 13X depicted in FIG. 8, 10, 11, 12, 13, 14, or 15, respectively). The base includes a wide portion (e.g., the wide portion 13B, 13BT, 13BU, or 13BV depicted in FIG. 8, 11, 12, or 13, respectively) and a surface (e.g., the adhering surface 13AA depicted in FIG. 8) on which the energy generators are disposed. The wide portion has a width longer than a width of the surface on which the energy generators are disposed, in a short direction of the base. Alternatively, the base may further include a chamfer (e.g., the chamfer 13C depicted in FIG. 10) and a wide portion (e.g., the wide portion 13B depicted in FIG. 10). The chamfer is provided on an edge of the surface on which the energy generators are disposed in the short direction of the base. The wide portion has a width longer than the width of the surface on which the energy generators are disposed, in the short-direction of the base. Thus, warp of the base may be reduced without increasing the height or width of the base. As a result, a long liquid discharging head may be manufactured at low costs.

A liquid discharging device (e.g., the liquid discharging device 237 depicted in FIG. 1 or the image forming device 402 depicted in FIG. 3) and an image forming apparatus (e.g., the image forming apparatus 200 or 401 depicted in FIG. 1 or 3, respectively) according to the above-described exemplary embodiments may include the long liquid discharging head manufactured at low costs.

As described above, when a line-type image forming apparatus (e.g., the image forming apparatus 401 depicted in FIG. 3) includes the liquid discharging head according to the above-described exemplary embodiments, the liquid discharging head may be manufactured at low costs. Namely, the liquid discharging device and the image forming apparatus, which include the liquid discharging head to form an image at an increased speed, may be manufactured at low costs.

The liquid discharging device and the image forming apparatus which include the liquid discharging head according to the above-described exemplary embodiments, may be applied to or may include an image forming apparatus having one of copying, printing, and facsimile functions and an image forming apparatus (e.g., a multi-function printer) having two or more of copying, printing, and facsimile functions. The above-described exemplary embodiments may be applied to an image forming apparatus using recording liquid other than ink, fixing liquid, and/or the like and to a liquid discharging device for discharging various liquids.

According to the above-described exemplary embodiments, the image forming apparatus includes an apparatus for forming an image by discharging liquid. A recording medium, on which the image forming apparatus forms an image, includes paper, strings, fiber, cloth, leather, metal, plastic, glass, wood, ceramics, and/or the like. An image formed by the image forming apparatus includes a character, a letter, graphics, a pattern, and/or the like. Liquid, with which the image forming apparatus forms an image, is not limited to ink but includes any fluid and any substance which becomes fluid when discharged from the liquid discharging head. The liquid discharging head may discharge liquid not forming an image as well as liquid forming an image. The liquid discharging device is not limited to a device for forming an image, but includes any device for discharging liquid.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese patent application No. 2006-302174 filed on Nov. 8, 2006 in the Japan Patent Office, the entire contents of which are hereby incorporated herein by reference.

What is claimed is:

1. A liquid discharging head, comprising:

a nozzle configured to discharge a liquid drop;

a pressing liquid chamber connected to the nozzle and configured to contain liquid;

a plurality of energy generators configured to generate energy for applying pressure to liquid contained in the pressing liquid chamber; and a base on which the plurality of energy generators is provided in a longitudinal direction of the base, the base comprising:

a relatively narrower portion including an adhering surface, the plurality of energy generators being disposed on the adhering surface, and the relatively narrower portion being bounded by a first bounding width (W1) in a short direction of the base, the short direction being perpendicular to the longitudinal direction; and a wide portion having a second bounding width (W2) in the short direction of the base greater than the first bounding width (W1) of the relatively narrower portion of the base, the wide portion comprising a base surface opposing the adhering surface of the relatively narrower portion of the base, wherein the plurality of energy generators are collectively bounded in the short direction of the base by another bounding width, the first bounding width (W1) of the relatively narrower portion of the base is less than or equal to said another bounding width of the energy generators, and said another bounding width of the energy generators is less than the second bounding width (W2) of the wide portion of the base.

2. The liquid discharging head according to claim 1, wherein the base further includes a chamfer provided on an edge of the plurality of adhering surfaces in the short direction of the base.

3. The liquid discharging head according to claim 1, wherein the base has a substantially cruciform shape in a cross-section along the short direction of the base.

4. The liquid discharging head according to claim 1, wherein the base has a substantially trapezoidal shape in a cross-section along the short direction of the base.

5. The liquid discharging head according to claim 1, wherein the base further includes a projecting portion configured to project outward from an edge surface of the base in the short direction of the base and at least one slit provided between adjacent sections of the projecting portion, the adjacent sections being arranged in the longitudinal direction of the base.

6. The liquid discharging head according to claim 1, wherein the base further includes a projecting portion configured to project outward from an edge surface of the base in the short direction of the base, the projecting portion being sequentially provided along the longitudinal direction of the base to form the wide portion and including a hole.

7. The liquid discharging head according to claim 1, wherein the base has a linear expansion coefficient of about 10E-6/° C. or smaller.

8. The liquid discharging head according to claim 7, wherein the base includes stainless steel.

9. The liquid discharging head according to claim 1, wherein the base has a substantially cruciform shape in a cross-section along the short direction of the base.

10. The liquid discharging head according to claim 2, wherein the base has a substantially trapezoidal shape in a cross-section along the short direction of the base.

11. The liquid discharging head according to claim 2, wherein the base further includes a projecting portion configured to project outward from an edge surface of the base in the short direction of the base and at least one slit provided between adjacent sections of the projecting portion, the adjacent sections being arranged in the longitudinal direction of the base.

12. The liquid discharging head according to claim 2, wherein the base further includes a projecting portion configured to project outward from an edge surface of the base in the short direction of the base, the projecting portion being sequentially provided along the longitudinal direction of the base to form the wide portion and including a hole.

13. The liquid discharging head according to claim 2, wherein the base has a linear expansion coefficient of about 10E-6/° C. or smaller.

14. The liquid discharging head according to claim 13, wherein the base includes stainless steel.

15. A liquid discharging device, comprising:

a liquid discharging head configured to discharge a liquid drop, the liquid discharging head comprising:

a nozzle configured to discharge the liquid drop;

a pressing liquid chamber connected to the nozzle and configured to contain liquid;

a plurality of energy generators configured to generate energy for applying pressure to liquid contained in the pressing liquid chamber; and a base on which the plurality of energy generators is provided in a longitudinal direction of the base, the base comprising:

a relatively narrower portion including an adhering surface, the plurality of energy generators being disposed on the adhering surface, and the relatively narrower portion being bounded by a first bounding width (W1) in a short direction of the base, the short direction being perpendicular to the longitudinal direction; and a wide portion having a second bounding width (W2) in the short direction of the base greater than the first bounding width (W1) of the relatively narrower portion of the base, the wide portion comprising a base surface opposing the adhering surface of the relatively narrower portion of the base, wherein the plurality of energy generators are collectively bounded in the short direction of the base by another bounding width, the first bounding width (W1) of the relatively narrower portion of the base is less than or equal to said another bounding width of the energy generators, and said another bounding width of the energy generators is less than the second bounding width (W2) of the wide portion of the base.

16. An image forming apparatus, comprising:

a liquid discharging head configured to discharge a liquid drop, the liquid discharging head comprising:

a nozzle configured to discharge the liquid drop to form an image;

a pressing liquid chamber connected to the nozzle and configured to contain liquid;

a plurality of energy generators configured to generate energy for applying pressure to liquid contained in the pressing liquid chamber; and a base on which the plurality of energy generators is provided in a longitudinal direction of the base, the base comprising:

a relatively narrower portion including an adhering surface, the plurality of energy generators being disposed on the adhering surface, and the relatively narrower portion being bounded by a first bounding width (W1) in a short direction of the base, the short direction being perpendicular to the longitudinal direction; and a wide portion having a second bounding width (W2) in the short direction of the base greater than the first bounding width (W1) of the relatively narrower portion of the base, the wide portion comprising a base surface opposing the adhering surface of the relatively narrower portion of the base, wherein the plurality of energy generators are collectively bounded in the short direction of the base by another bounding width, the first bounding width (W1) of the relatively narrower portion of the base is less than or equal to said another bounding width of the energy generators, and said another bounding width of the energy generators is less than the second bounding width (W2) of the wide portion of the base.

17. The liquid discharging head of claim 1, wherein the plurality of energy generators are arranged in at least two rows, the at least two rows being arranged parallel to the longitudinal direction.

18. The liquid discharging head according to claim 1, wherein the first bounding width (W1) is the width of the adhering surface, and the second bounding width (W2) is the width of the base surface.

* * * * *